US009566816B2

(12) United States Patent
Schloerlholz

(10) Patent No.: US 9,566,816 B2
(45) Date of Patent: Feb. 14, 2017

(54) METHOD FOR PRINTING ON AN OBJECT IN AN INKJET PRINTING PROCESS

(71) Applicant: HEIDELBERGER DRUCKMASCHINEN AG, Heidelberg (DE)

(72) Inventor: Matthias Schloerlholz, Plankstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/938,883

(22) Filed: Nov. 12, 2015

(65) Prior Publication Data

US 2016/0136970 A1 May 19, 2016

(30) Foreign Application Priority Data

Nov. 14, 2014 (DE) ..... 10 2014 223 310

(51) Int. Cl.
*B41M 7/00* (2006.01)
*B41M 5/00* (2006.01)

(52) U.S. Cl.
CPC ..... *B41M 7/009* (2013.01); *B41M 5/0047* (2013.01); *B41M 5/0064* (2013.01); *B41M 7/0081* (2013.01)

(58) Field of Classification Search
CPC .. B41M 5/0041; B41M 5/0047; B41M 5/0064
See application file for complete search history.

(56) References Cited

U.S. PATENT DOCUMENTS

| | | | | |
|---|---|---|---|---|
| 3,674,598 | A | 7/1972 | Mayer et al. | |
| 6,844,142 | B2 | 1/2005 | Schadebrodt et al. | |
| 2006/0023045 | A1* | 2/2006 | Yokoyama | B41J 11/002 347/102 |

FOREIGN PATENT DOCUMENTS

| | | | | |
|---|---|---|---|---|
| DE | 10241851 | A1 | 3/2004 | |
| EP | 2399751 | A1 | 12/2011 | |
| JP | 2002210936 | * | 7/2002 | B41J 2/01 |
| JP | 2002210936 | A | 7/2002 | |
| JP | 2009221365 | A | 10/2009 | |
| JP | 2011098509 | A | 5/2011 | |
| JP | 2012040742 | A | 3/2012 | |

* cited by examiner

*Primary Examiner* — Henok Legesse
(74) *Attorney, Agent, or Firm* — Laurence A. Greenberg; Werner H. Stemer; Ralph E. Locher

(57) ABSTRACT

A method for printing on an object, for instance on an object made of a foamed material, includes applying ink to a surface of the object in accordance with digital image information in an inkjet printing process and irradiating the ink by electromagnetic radiation, preferably containing an IR proportion, to cure or dry the ink. The ink is directly heated by the irradiation and the material of the surface is indirectly heated by the irradiation by thermal conduction from the ink, causing the material in a region to experience a volume change. In this way, it is possible to simultaneously print on the material and to provide the material with a relief structure/to digitally emboss it.

12 Claims, 1 Drawing Sheet

METHOD FOR PRINTING ON AN OBJECT IN AN INKJET PRINTING PROCESS

CROSS-REFERENCE TO RELATED APPLICATION

This application claims the priority, under 35 U.S.C. §119, of German Patent Application DE 10 2014 223 310.0, filed Nov. 14, 2014; the prior application is herewith incorporated by reference in its entirety.

BACKGROUND OF THE INVENTION

Field of the Invention

The invention relates to a method for printing on an object in which ink is applied to a surface of the object in accordance with digital image information in an inkjet printing process and the ink is irradiated by electromagnetic radiation to cure or dry the ink.

Japanese Patent Application JP 2002 210 936 A describes a method for printing on a container made of Styrofoam® material using hotmelt ink for inkjet processes. The heat that is introduced in that process causes the ink and material to soften and the ink to adhere well to the material. Japanese Patent Application JP 2012 040 742 A likewise describes printing on Styrofoam® by inkjet printing. Both documents do not mention a changing of the structure of the material.

U.S. Pat. No. 3,674,598A discloses the creation of a 3D image by applying a color liquid containing a solvent from a bottle to a Styrofoam® material. The solvent liquefies the material, causing the trace of the bottle or rather of the colored liquid to sink into the material and to simultaneously color the material. The method is based on the chemical solving effect. Thermal effects are not mentioned.

Through the use of a printer known as "Jetmaster Dimension," manufactured by Heidelberger Druckmaschinen AG, it is possible to print on 3D objects using inkjet ink and to dry the ink on the object (as seen in the following link: http://youtu.be/lup5UIBNBTo).

In the more remote technical field of creating printing forms, German Patent Application DE 10 241 851 A1, corresponding to U.S. Pat. No. 6,844,142, describes the creation of a flexographic printing form. Inkjet printing ink is printed onto the printing form, which is subsequently irradiated with UV ink and thermally developed. In a final step, non-polymerized portions of the printing form are removed.

SUMMARY OF THE INVENTION

It is accordingly an object of the invention to provide an improved method for automated printing on an object in an inkjet printing process, which overcomes the hereinafore-mentioned disadvantages of the heretofore-known methods of this general type, which allows a printed image to be created that is visually discernible due to the ink that is used and which at the same time allows a printed image to be created that is visually and/or haptically discernible due to a relief structure (in addition to the ink structure). In this way, the improved method is intended to allow synchronous digital embossing, i.e. to provide a fast and cost-efficient embossing process to be carried out during the printing process using any desired varying embossing patterns without any mechanical embossing die.

With the foregoing and other objects in view there is provided, in accordance with the invention, a method for printing on an object in which ink is applied to the surface of the object in a so-called inkjet printing process in accordance with digital image information and in which the ink is treated with electromagnetic radiation to be cured or dried. The ink is directly heated by the irradiation. The material of the surface in a region underneath the ink is indirectly heated by the irradiation due to thermal conduction from the ink causing a region of the material to experience a volume change.

In an advantageous way, the volume change results in the formation of a relief structure, i.e. of a surface structure that has raised (high or elevated) and depressed (lower or sunken) regions. Such a structure thus forms a 3D structure, i.e. a 3D surface. In an advantageous way, the structure is optically discernible due to the use of color ink. In addition, the structure is optically and/or haptically discernible due to the relief. The printed product has thus been enhanced in optical and functional terms. The enhanced function may, for instance, be the new haptic properties of the object, which may allow the printed image to be read by people with impaired vision. The printed image may, for instance, be Braille letters (text). In addition to text, it is possible to construct "legible" images or patterns. In addition to the haptic aspect, the visual effect of the printed image changes. The sunken or raised ink regions create "mountains" and "valleys," resulting in shadow effects when illuminated from the side. The visual effect may even be similar to the known embossing effect in its optical/haptic appearance. In this respect, the method of the invention represents a digital embossing process, i.e. a method for creating any desired, changing embossment patterns without any embossing die and in a quick and cost-efficient way.

The following example illustrates this effect: in an inkjet process, a pattern of 12 pentagons and 20 hexagons (truncated icosahedron, "soccer ball" pattern) is printed onto a Styrofoam® ball or sphere with a diameter of between 15 and 50 cm; the pentagons are printed with black ink, for instance. Infrared radiation is used to heat and cure the black ink. Due to thermal conduction, the Styrofoam® material in the regions underneath the ink, i.e. substantially in the pentagon regions, is heated. The regions in question sink in as the Styrofoam® partly melts and compacts. The printed ball finally looks like a soccer ball because not only does it have the well-known pattern, but also a three-dimensional surface structure that makes it look more realistic and genuine.

The object may have a flat or curved surface, for instance a spherical surface. The ink is preferably dark ink such as black, and absorbs infrared light.

The irradiation may occur over the entire surface, i.e. the printed section on the surface may be irradiated in its entirety. Alternatively, it is possible to only irradiate those regions of the section in which ink is actually applied. For this purpose, the use of an emitter that includes a line or matrix of individually controllable light sources may be envisaged. The light sources may preferably be controlled by data that correspond to the image information data.

The ink may contain added infrared absorbers. The method may also envisage the application, for instance in an inkjet process, of a so-called primer (adhesion-promoting agent) underneath the ink in the locations that are to be printed on. The primer, which is preferably colorless, may contain added infrared absorbers.

In accordance with another mode of the invention, a reduction of the volume in the region (or an increase in density), causes the ink to sink in, or an increase in the volume in this region (or a reduction of the density), causes the ink to be raised. Causing the ink to sink into the material may be achieved with Styrofoam®, for instance: heat causes the polystyrene material to melt, allowing the enclosed air to escape. As a result, the Styrofoam® in the region underneath the heated ink compacts and a depression is formed in which the ink comes to lie. A raising of the ink may be achieved by a material that expands, swells, or foams when heated and keeps its increased volume when it cools, for instance a thermoplastic containing intumescence additives. In a case in which different materials have been selected for at least two locations of the object, a sinking-in of the ink may be envisaged in one location and a raising of the ink may be envisaged in another location. In such a case, the raising and/or sinking may create a relief or embossment structure.

The depth or height of the structure may be adjusted in different ways, for instance through the absorption behavior of the ink and/or through a selection of the emitter (in terms of geometry, cooling etc.).

The structure that has been created in this way may be printed on again. A filling of the depressions with further printing liquid, e.g. more ink of a different color, for instance, or transparent varnish, may also be envisaged.

In accordance with a further mode of the invention, the electromagnetic radiation includes ultraviolet radiation that cures the ink by cross-linking. In this case the ink preferably is a so-called UV ink. In accordance with an added mode of the invention, the electromagnetic radiation includes infrared radiation. For UV inks, the radiation preferably contains a relatively high UV proportion and a relatively low IR proportion, casing the ink to be properly cross-linked and to be heated just enough to cause the volume of the material to change. This advantageously prevents the material from being heated too much and from being damaged beyond a mere change in volume. In addition, this measure prevents the UV ink from becoming too hot and getting burned and/or becoming dulled as a consequence.

In accordance with an additional mode of the invention, the electromagnetic radiation includes infrared radiation that dries the ink by dehumidification. In this case, the ink is preferably water-based. However, other solvents or solvent blends may be provided. In accordance with this further development, the IR radiation for drying is the same as the radiation for creating the 3D structure. Thus the radiation is used multifunctionally.

In accordance with yet another mode of the invention, the material does not or substantially does not absorb the electromagnetic radiation. When IR radiation is used, which is absorbed well by dark inks, for instance, the material of the object may preferably be selected to be light or even white. White Styrofoam® is a preferred material of this type.

In accordance with yet a further mode of the invention, the material in the region is melted. White Styrofoam® is a fusible and thus preferred material. Other examples are polyethylene (PE), polyurethane (PU), or polyethylene terephthalate (PET).

In accordance with yet an added mode of the invention, the material is foamed, in particular rigid expanded polystyrene (EPS or Styrofoam®).

In accordance with yet an additional mode of the invention, the material loses its expanded condition by being heated in the region. Again, an example of this is Styrofoam®, which is formed of foam balls that stick together. When heated to a sufficient temperature, these foam balls melt and release the trapped air. Thus the material compacts in the region and its volume decreases.

In accordance with a concomitant mode of the invention, the object and an inkjet print head for expelling the ink as well as the object and an emitter for generating the radiation are moved relative to one another by a single-axle or multi-axle robot. During an ongoing printing and simultaneous embossing process, the print head, the emitter, the single-axle or multi-axle robot, and the object may be located in a housing of an object printer, for instance in a printer known as "Jetmaster Dimension," manufactured by Heidelberger Druckmaschinen AG.

Other features which are considered as characteristic for the invention are set forth in the appended claims.

Although the invention is illustrated and described herein as embodied in a method for printing on an object in an inkjet printing process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
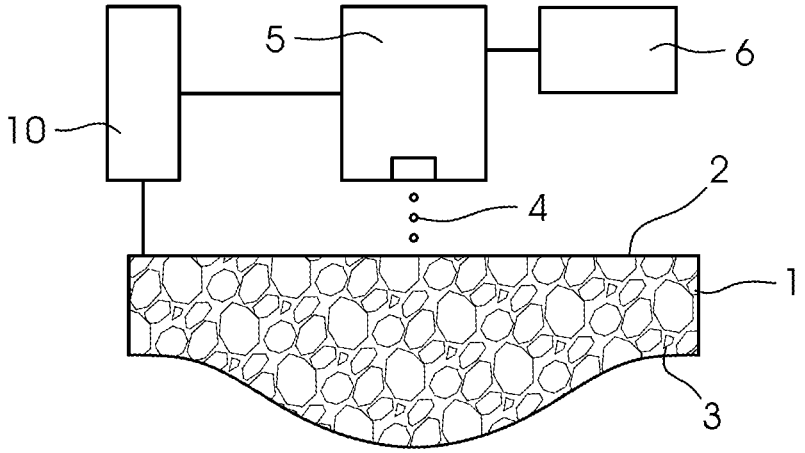
FIG. 1 is a diagrammatic representation of a device as it carries out a preferred embodiment of the method of the invention on an object.

Referring now to the figures of the drawings in detail and first, particularly, to FIG. 1 thereof, there is seen a diagrammatic representation of a device as it carries out a (first step of a) preferred embodiment of the method of the invention. An object 1 is shown that has a surface 2. The material 3 of the object may be Styrofoam®, for instance. Ink 4 is applied to the surface 2 by a print head 5. The print head 5 generates ink droplets. In a preferred embodiment, a computer 6 is provided to control the print head in accordance with image information (text, pattern, image, etc.) that is to be printed. The print head may move along the surface 2. Alternatively, the print head may be stationary and the surface may move along the print head. Alternatively, the print head may be moved in one direction (x direction, for instance), and the substrate may move in another direction (y direction, for instance). All of the alternatives may envisage the use of a robot that is controlled to maintain a printing distance during a printing process to prevent collisions. A single-axle or multi-axle robot 10 may move the object 1 and the inkjet print head 5 as well as the object 1 and the emitter 7 relative to one another. The ink is preferably black ink that is cured by UV radiation.

Figure 2:
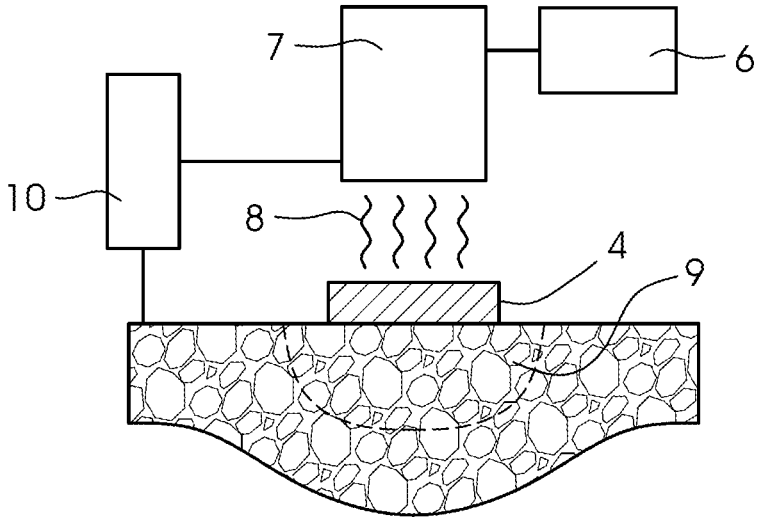
FIG. 2 is a view similar to FIG. 1 illustrating the implementation of another step of the method of the invention.

FIG. 2 illustrates the implementation of another (second) step of the method of the invention shown in FIG. 1. Ink 4 has been applied to the surface 2 of the object 1 in the form of a layer of droplets that have run into one another or in the form of individual droplets. Now the ink is irradiated by an emitter 7. For this purpose, the emitter 7 generates radiation 8. In the illustrated example, the radiation is UV radiation with an IR proportion. The emitter may be a so-called D-lamp, i. e. a doped Hg-lamp, e. g. an iron-doped Hg-lamp. It may have a power of 100 W and may be guided across the surface at a relative speed of 200 mm/s. The emitter primarily generates UV radiation, but also IR radiation. Alternatively, two emitters may be used, one for generating UV radiation and one for generating IR radiation. Alternatively, an emitter generating exclusively IR radiation may be used when the applied ink is thermally-cured ink. The emitter is controlled by the computer 6.

Figure 3:
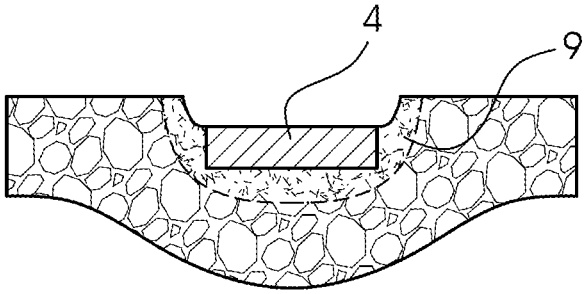
FIG. 3 is a view similar to FIGS. 1 and 2 illustrating the implementation of a further step of the method of the invention.

FIG. 3 illustrates the implementation of a further (third) step of the method of the invention shown in FIGS. 1 and 2. Irradiation with light of an infrared wavelength range causes the ink 4 to heat up. Through heat conduction, the heated ink transmits thermal energy to the adjacent material 3, in particular to material 3 located underneath the ink. In a heated region 9 (see FIG. 2), the heating results in a volume reduction and a density increase of the material 3. The region, including the ink, sinks into the material and a depression is created. Once the ink has cooled down and the material has solidified, the depression remains as a decorative and/or functional element.

The invention claimed is:

1. A method for printing on an object, the method comprising the following steps:

providing an object having surface formed of a material;

applying ink to the surface of the object in accordance with digital image information in an inkjet printing process;

directly heating the ink by irradiating the ink using electromagnetic radiation to cure or dry the ink; and indirectly heating the material of the surface in a region underneath the ink using the radiation by thermal conduction from the ink, causing the material in the region to experience a volume change.

2. The method according to claim 1, which further comprises:

reducing a volume in the region, causing the ink to sink in, or increasing the volume in the region, causing the ink to be raised.

3. The method according to claim 1, wherein the electromagnetic radiation includes ultraviolet radiation curing the ink by cross-linking.

4. The method according to claim 1, wherein the electromagnetic radiation includes infrared radiation.

5. The method according to claim 1, wherein the electromagnetic radiation includes infrared radiation drying the ink by dehumidification.

6. The method according to claim 1, wherein the material does not absorb the electromagnetic radiation.

7. The method according to claim 1, which further comprises melting the material in the region.

8. The method according to claim 1, wherein the material is a foamed material.

9. The method according to claim 8, wherein the material in the region loses its foamed condition.

10. The method according to claim 1, wherein the material is a foamed rigid expanded polystyrene.

11. The method according to claim 10, wherein the material in the region loses its foamed condition.

12. The method according to claim 1, which further comprises:

carrying out the step of applying ink to the surface of the object by using an inkjet print head;

carrying out the step of irradiating the ink by using an emitter; and moving the object and the inkjet print head as well as the object and the emitter relative to one another by using a single-axle or multi-axle robot.

* * * * *